US005324096A

United States Patent [19]

Schultz

[11] Patent Number: 5,324,096

[45] Date of Patent: Jun. 28, 1994

[54] ADJUSTABLE HEIGHT CHAIR ARM

[75] Inventor: Craig H. Schultz, Muscatine, Iowa

[73] Assignee: Hon Industries Inc., Muscatine, Iowa

[21] Appl. No.: 844,130

[22] Filed: Mar. 2, 1992

[51] Int. Cl.[5] ..... A47C 7/54

[52] U.S. Cl. ..... 297/411.36; 297/353

[58] Field of Search ..... 297/353, 410, 411; 248/297.3, 408, 409; 403/107, 322

[56] References Cited

U.S. PATENT DOCUMENTS

| | | | |
|---|---|---|---|
| 455,168 | 6/1891 | Case . | |
| 2,235,292 | 7/1943 | Westrope . | |
| 3,142,194 | 7/1964 | Garden . | |
| 3,474,993 | 10/1969 | Murcott . | |
| 3,747,976 | 7/1973 | Lacey . | |
| 4,036,525 | 7/1977 | Howk | 297/353 |
| 4,153,296 | 5/1979 | Rhamstine . | |
| 4,267,748 | 5/1981 | Grunewald . | |
| 4,401,006 | 8/1983 | Sekiguchi . | |
| 4,546,668 | 10/1985 | Mattsson | 248/408 X |
| 4,659,135 | 4/1987 | Johnson . | |
| 4,660,885 | 4/1987 | Suhr et al. | 297/353 |
| 4,828,323 | 5/1989 | Brodersen . | |

*Primary Examiner*—Peter R. Brown

*Attorney, Agent, or Firm*—Jones, Day, Reavis & Pogue

[57] ABSTRACT

An adjustable chair arm assembly is provided which can be vertically adjusted in order to readily accommodate users of different sizes. The chair arm assembly provides support members having overlapping portions which cooperate to slide vertically with respect to each other. One of the support members maintains a relatively fixed position with the chair and the other support member, having an arm rest, slides vertically with respect to the first support member to adjust the height of the arm rest.

A series of support projections are vertically disposed along the overlapping portion of one of the support members. A latch member, mounted for sliding movement along the support projections, has at least one latch projection for selectively engaging the support projections at any position therealong. Resilient member is coupled to the latch projection for urging the latch projection into engagement with the support projections thereby preventing the support members from sliding with respect to each other for supporting the arm rest in any selected height position.

A pivotable actuator is coupled to the second support member and attached to the latch projection for supporting the load created when the user leans on the arm rest, and for selectively retracting the latch projection from the support projections, thereby permitting sliding movement between the support members in order to adjust the height of the arm rest. When the actuator is released, the resilient biasing member urges the latch projection to reenage the support projections in the selected position.

27 Claims, 5 Drawing Sheets

ADJUSTABLE HEIGHT CHAIR ARM

FIELD OF THE INVENTION

The present invention relates generally to arm chairs and more particularly to arm chairs having height-adjustable arm rests.

BACKGROUND OF THE INVENTION

Arm chairs typically have arm rests in order to provide increased comfort and to decrease fatigue by providing support for the user's arms and lateral support for the body. In some instances, the chairs have latch mechanisms which adjust the height of the arm rests to accommodate users of different sizes. In many instances, however, the latch mechanisms are complex, having numerous parts, and difficult to use.

OBJECTS AND SUMMARY OF THE INVENTION

It is an object of the present invention to provide a novel adjustable arm rest for a chair in which the height of the arm rest can be easily adjusted.

It is another object of the present invention to provide an adjustable arm rest which can be easily, quickly and inexpensively manufactured and assembled.

A further object is to provide a latch mechanism for adjusting the height of an arm rest which is reliable, simple and fully enclosed in the chair arm.

The present invention is generally directed to an adjustable chair arm assembly. The invention provides unique structural features which permit the latch mechanism to be quickly and easily assembled and, once installed, to be easily adjusted without the need for tools.

The adjustable chair arm assembly provides two support members having overlapping portions which cooperate to slide vertically with respect to each other, one maintains a relatively fixed position with the chair and the other carries an arm rest, to adjust the height of the arm rest.

One of these support members has a series of support projections vertically disposed along the overlapping portion. A latch member, mounted for sliding movement along the support projection has at least one latch projection for selectively engaging the support projections at any position therealong. Resilient means is coupled to the latch member for urging the latch projection into engagement with the support projections.

Manipulatable handle means supportably engaged with the support member carrying the arm rest and attached to the latch member, is provided for selectively retracting the latch projection from the support projections, thereby permitting sliding movement between the support members in order to adjust the height of the arm rest. When the handle means is released, the resilient means urges the latch projection to reengage the support projections in the selected position, thereby preventing the support members from sliding with respect to each other for supporting the arm rest in any selected height position. The handle means is coupled to the support member carrying the arm rest to provide support engagement therewith, thereby supporting the load created when the user leans on the arm rest. It will be appreciated that since the handle means and latch member are attached, any load on the second support member carrying the arm rest will be transmitted to the first support member through the support projections.

In the preferred embodiment of the invention, the first support member having a substantially vertical upright portion is attached to the chair. The second support member has an arm rest and an upright tubular portion slidably receiving therein the upright portion of the first support member. The upright portion of the first support member has an opening for receiving at least one tooth track plate. The tooth track plate has an opening formed by two opposing and parallel side walls, at least one of the walls having the series of support projections.

The latch member, supported by the support projections and mounted for sliding movement in the opening of the tooth track plates, has a latch projection and an integral U-shaped spring means which urges the latch projection to engage the support projections and thereby prevent the latch member from sliding within the opening of the tooth track plate. The end of the latch projection has a toe for securely hooking engagement with a toe disposed on the end of each of the support projections.

A handle is rigidly attached to the latch member for selectively retracting the latch projection from the support projections, permitting the latch member to slide within the opening of the tooth track plate. The spring arm of the latch member urges the latch projection to reengage the support projections when the handle is released. The handle, coupled to the second support member, supports the load created when a user leans on the arm rest.

In order to adjust the height of the arm rest, the handle is rotated so that the latch projection is retracted from the support projections, thereby permitting the latch member to slide vertically within the opening of the tooth track plate. Since the handle is coupled to both the second support member and the latch member, the handle, the second support member, the arm rest and the spring will slide in unison to the desired height position. When the desired position of the arm rest is reached, the handle is released permitting the spring arm to urge the latch projection to engage the support projections, thereby preventing the latch member, the handle and the arm rest from further vertical movement.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
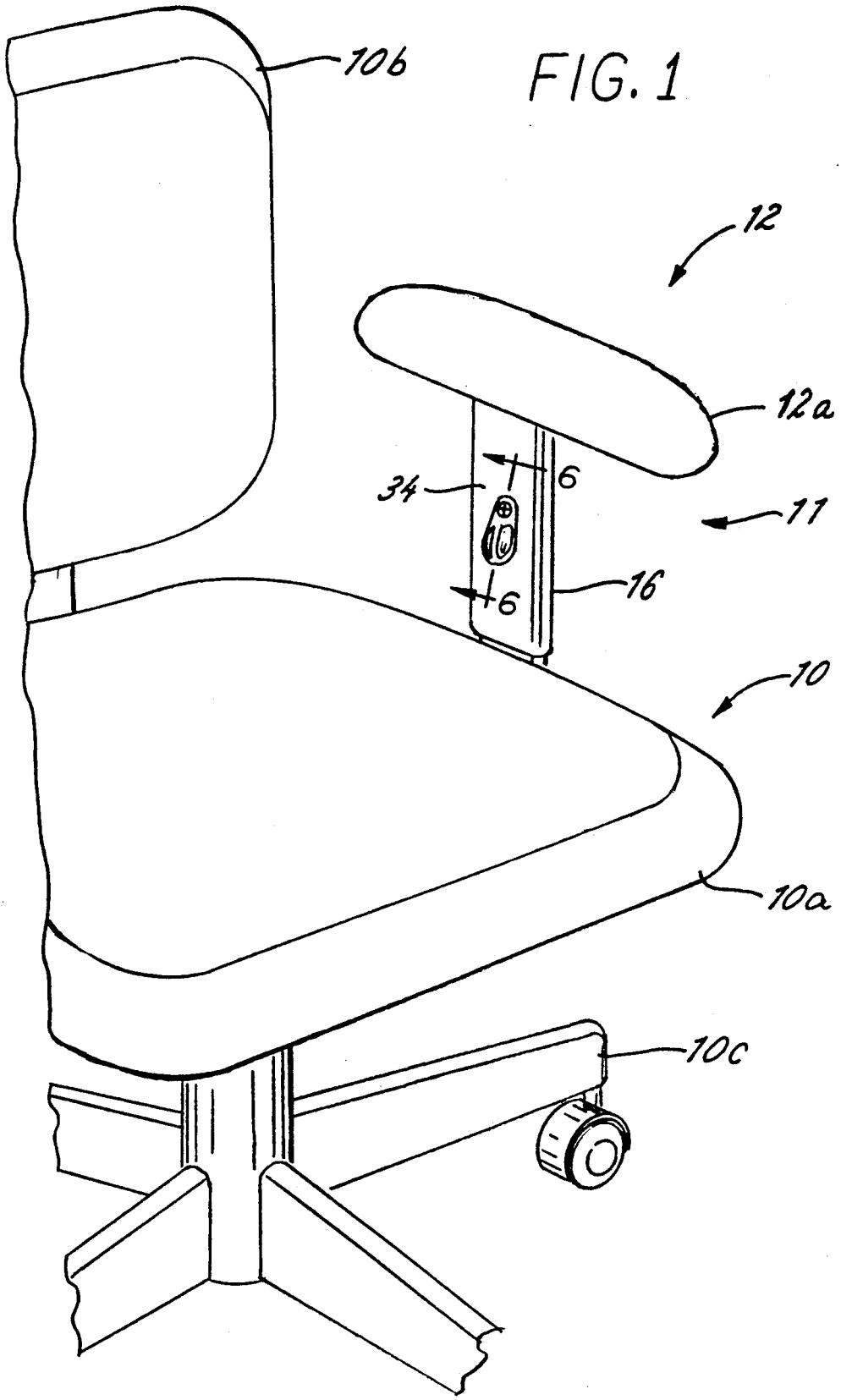
FIG. 1 is a perspective view of a chair having an adjustable arm rest according to the present invention.

Referring to FIG. 1, there is shown a perspective view of a typical chair 10 having an adjustable chair arm 11 for adjusting the height of the arm rest 12 according to the present invention. A typical chair will have a seat 10*a*, a back support 10*b* and a leg assembly 10*c* so that a person can sit in the chair 10. The chair 10 also has a chair arm 11 to provide support for the user's arms and lateral support for the user's body.

In accordance with one of the objects of the present invention, a chair arm 11 is provided which can be vertically adjusted easily in order to readily accommodate users of different sizes. The chair arm 11 is comprised of a first support member 14 which provides means for attaching the chair arm 11 to the support structure for the seat 10*a* and a second support member 16 which cooperates with the first support member 14 to provide means for vertically adjusting the height of the arm rest 12.

Figure 2:
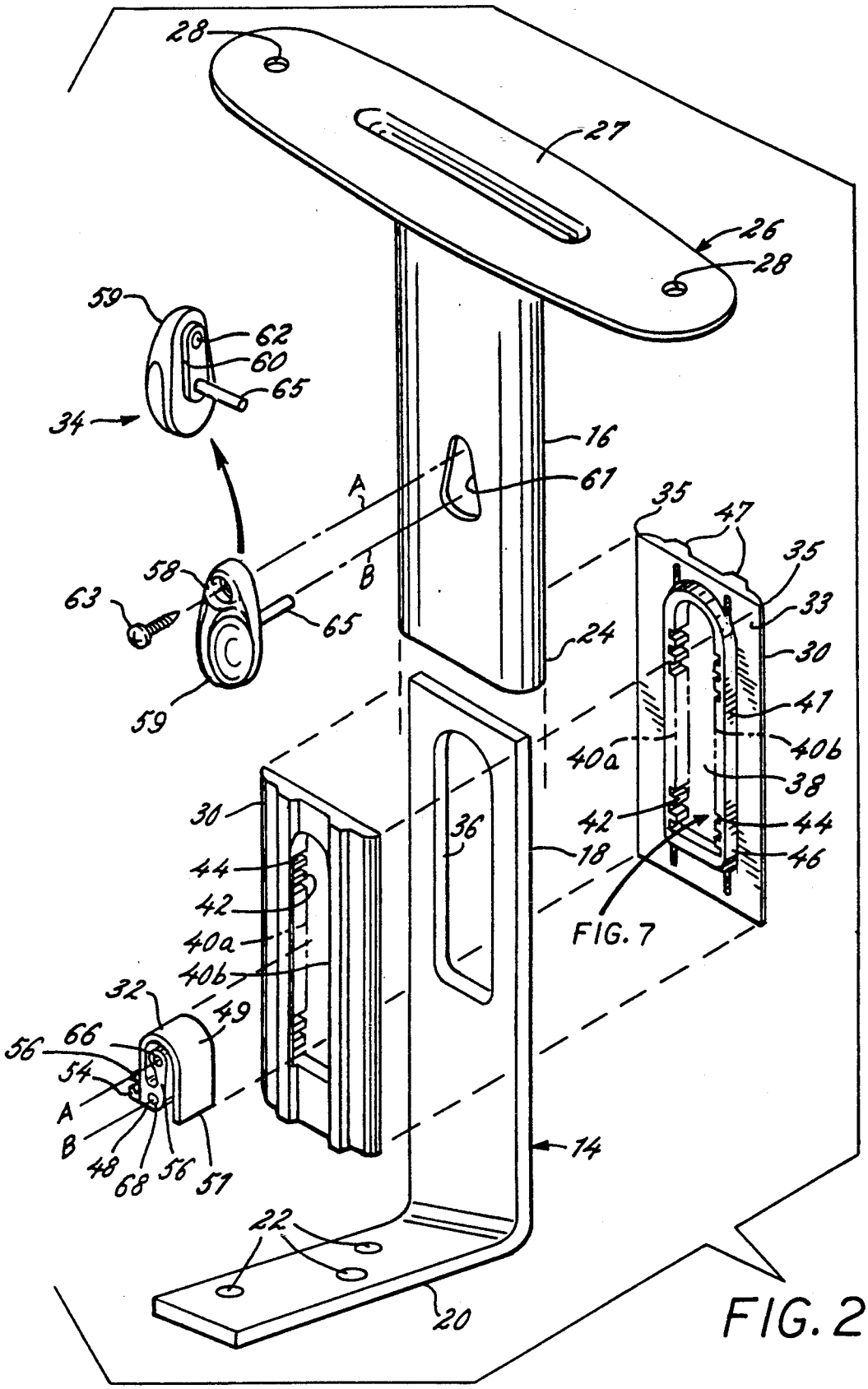
FIG. 2 is an exploded view of the chair arm and the latch mechanism for adjusting the height of the chair arm according to the preferred embodiment of the present invention.

In the embodiment illustrated in FIG. 2, the first support member 14 is generally L-shaped, having an upright portion 18 and bottom portion 20. A plurality of holes 22 are located on the bottom portion 20 for receiving attaching means such as screws and the like for attaching the first support member 14 to seat structure 10*a*. When the bottom portion 20 of the first support member 14 is attached to the chair 10, the upright portion 18 is substantially vertical and the vertical position of the first support member 14, the seat 10*a* and the user are maintained in substantially fixed positional relationship with each other.

Since the first support member 14 remains relatively stationary with respect to the seat 10*a*, only the vertical height of the second support member 16 must be adjusted in order to accommodate users of different sizes. In the illustrated embodiment, the second support member 16 moves vertically with respect to the first support member 14 in order to adjust the vertical height of the arm rest 12. The second support member 16 is generally T-shaped, having an arm rest portion 26 and an upright tubular portion 24 for slidably receiving the upright portion 18 of the first support member 14. The upright tubular portion 24 permits the second support member 16 to slide vertically with respect to the relatively stationary first support member 14. It will be appreciated that the upright tubular portion 24 of the second support member 16 overlaps and telescopes over the upright portion 18 of the first support member 14.

The arm rest portion 26 of the second support member 16 includes means such as plate 27 to receive an arm rest 12, for supporting the user's arm. In order to provide more comfort for the user, a cushion 12*a* can be attached to the plate 27 using any conventional means such as a plurality of holes 28 disposed on plate 27 (as shown in FIG. 2) for receiving screws to attach the cushion 12*a* to plate 27.

A latch mechanism is provided for supporting the second support member 16 and for selectively adjusting the vertical position of the arm rest 12 relative to the first support member 14. In the preferred embodiment, the latch mechanism comprises at least one tooth track plate 30 having a series of support projections 42 maintained in fixed vertical relationship with the first support member 14, a resilient spring latch member 32 having at least one latch projection 54 for engaging the support projections 42 and slidably mounted in the tooth track plate 30 for selective vertical movement relative to the first support member 14, and manipulatable handle means 34 connected to the spring latch member 32 for selectively retracting the latch projection 54 from the support projections 42 and for sliding the spring latch member 32 within the tooth track plate 30. As will be explained below, the support projections 42, in cooperation with the spring latch member 32 and the handle means 34, support the load created by the user leaning on the arm rest portion 26 of the second support member 16.

As illustrated in FIG. 2, the tooth track plate 30 includes a front 31, a rear 33, side portions 35 and an opening 38 having substantially parallel and opposing walls 40 which are formed to provide the support projections 42 along each side of the opening 38. It will be appreciated that the presence of support projections 42 on both sides of the opening 38 permits the latch member 32 to be inserted in the left hand orientation shown in FIGS. 3A and 3B or in a right hand orientation (not shown) in which the latch projection 54 would face the right side of FIG. 3A. However, the series of alternating teeth-like projections 42 and recesses 44 may be vertically disposed along only one of the walls 40 of the tooth track plate 30. As may be seen in FIGS. 3A and 3B, the support projections 42 are adapted to slidably receive the latch projection 54 of the spring latch member 32 therebetween, i.e., in the recess 44. Each individual projection 42 extends horizontally from the wall 40 and has a downwardly facing toe 42*a*. Toe 42*a* forms a 45° angle adapted to engage and hook an upwardly facing toe 54*a* also having a 45° angle, disposed on the latch projection 54 of the spring latch member 32, thereby forming a secure attachment. In practice, it has been found that ten support projections at quarter inch increments yielding a two and one quarter inch range of motion will meet most ergonomic needs.

The support projections 42 extend from the front 31 of the tooth track plate 30 and project out of the rear 33 of the tooth track plate 30. The recesses 44 are open at the rear 33 of the tooth track plate 30 to slidably receive the latch projection 54 during assembly of the latch mechanism while the front wall 43 reinforces the individual projections and prevents the latch projection 54 of the spring latch member 32 from sliding through during assembly as noted further below.

Substantial loads may be created by the user leaning on the arm rest portion 26 of the second support member 16. The support should be designed for loads of at least 300 pounds. Since the relatively small support projections 42 have to support these relatively large loads, the top surface of each support projection 42 is designed to be as flat and as wide as possible in order to distribute the load forces over the greatest surface area.

The tooth track plate 30 can be attached to the first support member 14 in any manner as long as the support projections 42 are maintained in fixed vertical relationship with respect to the first support member 14.

In the preferred embodiment illustrated in FIG. 2, a tooth track plate 30 engages in either side of the opening 36 in the first support member 14. In order to attach the tooth track plate 30, support projections 42 form a shoulder 46 projecting out from the rear 33 of the tooth track plate 30 for aligning with and snugly engaging in the opening 36. The shoulder 46 also reinforces and provides additional structural integrity for the relatively narrow support projections 42. A groove 41 extends around the outside of shoulder 46 to accommodate machining flaws such as burrs, flanges and the like, thereby insuring that the tooth track plate 30 will lie flat along the front and rear of the first support member 14.

Each shoulder 46 extends from the rear 33 of the tooth track plate 30 approximately half of the thickness of the opening 36. The individual support projections 42 of each tooth track 30 are substantially aligned with each other whereby each aligned pair of the teeth form a relatively large flat surface area to distribute the forces transmitted to the support projections 42 when a user leans on the arm rest portion 26. It will also be appreciated that opening 38 of the tooth track plate 30 will substantially align with the opening 36 of the first support member 14.

In an alternate embodiment (not shown), the tooth track plate 30 can be integrally formed with the first support member 14 according to conventional molding or machining techniques. In another embodiment (not shown), the latch mechanism may have a single tooth track plate 30 having tooth projections 42 and a shoulder 46 which extend through and engage substantially the entire thickness of the opening 36 from one side.

It will be appreciated that the upright tubular portion 24 of the second support member 16 will slidably receive the tooth track plate 30 attached to the upright member 18 of the first support member 14. As previously stated, the second support member 16 is slidably mounted on the upright portion 18 of the first support member 14. When the arm rest 12 is in its highest vertical position, the bottom of the second support member 16 encloses the entire opening 36 and the associated latch mechanism. Similarly, when the arm rest 12 is in its lowest position, the top of the first support member 14 abuts against the top of the second support member 16. In accordance with one of the objects of the present invention, it will be appreciated that the latch mechanism will always be enclosed by the upright tubular portion 24 of the second support member 16 which serves both safety and aesthetics.

Figure 4:
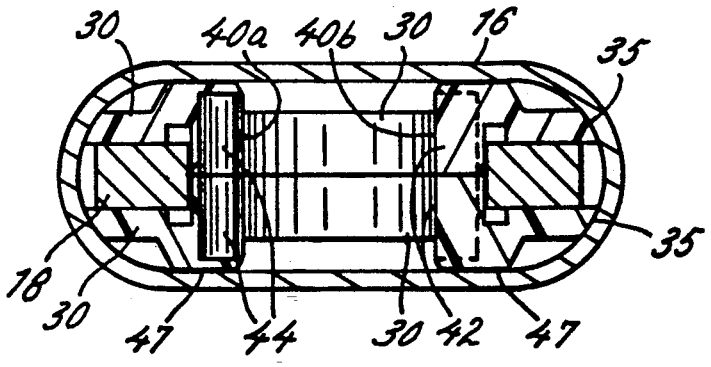
FIG. 4 is a cross-sectional view taken along line 4—4 in FIG. 3A and showing the support projections of the tooth track plates.
Figure 5:
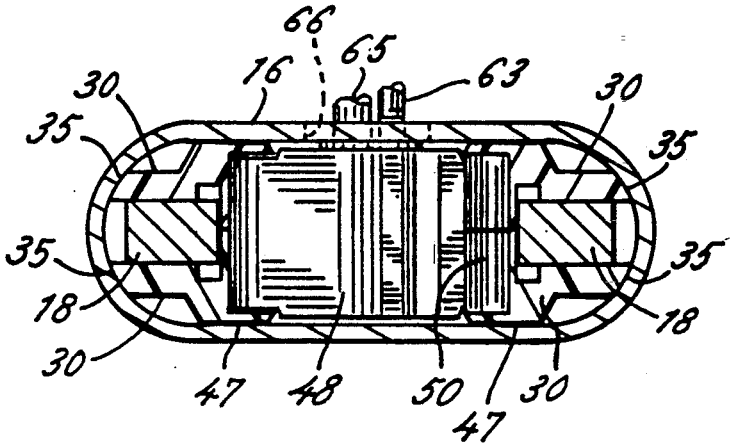
FIG. 5 is a cross-sectional view taken along line 5—5 in FIG. 3A showing the spring latch member engaging the tooth track plates.

The tooth track plates 30 are designed to provide a snug sliding fit with the interior walls of the upright tubular portion 18 of the second support member 16. Specifically, as shown in FIGS. 4 and 5 the front 31 of each tooth track plate 30 has a plurality of projecting side ribs 47 and the distal edges 35 extend beyond the first support member 14. Thus, when the tooth track plates 30 engage within the second support member 16, the ribs 47 and the edges 35 provide low friction snug engagement with the interior walls of the upright tubular portion 24 to maintain firm alignment of the telescoping parts with relatively easy sliding adjustability. The tooth track plate 30 is typically made of plastic for ease of manufacturing and to facilitate sliding engagement between the support members. It will be appreciated that, although the ribs 47 and the sides 35 of the tooth track plate 30 snugly engage the interior of the second support member 16, the contact area between the ribs 47 and edges 35 and the interior walls of the upright tubular portion 24 are relatively small, preferably having line contact, to minimize frictional forces during the sliding movement of the support members 14, 16.

The spring latch member 32 includes a latch portion having a first end 48 with at least one latch projection 54 and a U-shaped resilient spring portion 49 providing means for continuously urging the latch projection 54 into mating engagement with the support projections 42 of the tooth track plate 30. Handle means 34 are coupled to the first end 48 of the spring latch member 32 for moving the latch projection 54 from the first or fixed position shown in FIG. 3A to the second or retracted sliding position shown in FIG. 3B. In the first or fixed position, the support projections 42 engage the latch projection 54 and support the spring latch member 32, preventing the spring latch member 32 from sliding within opening 38 of the tooth track plate 30. In the second or retracted sliding position, the latch projection 54 is retracted from the support projections 42, permitting the spring latch member 32 to slide within opening 38 of the tooth track plate 30. When handle means 34 is released, the resilient means will force the latch projection 54 to engage the support projections 42, returning the spring latch member 32 to the fixed position.

In order to insure support for the loads created by the user leaning on the arm rest 12, the preferred embodiment of the spring latch member 32 has two latch projections to distribute the loads. Specifically, the spring latch member 32 includes a lower latch tooth 54 and an upper latch tooth 56 extending outwardly from the first end 48 of the spring latch member 32. The lower latch tooth 54 extends outwardly from the first end 48 and forms an upwardly projecting toe 54*a* having an inner engagement surface disposed at approximately a 45° angle, as noted above, to permit toes 42*a* and 54*a* to securely hook each other. It will also be appreciated that due to differences in their rotational paths, the upper latch tooth 56 will be slightly shorter than the lower tooth 54 in order insure simultaneous disengagement upon rotation of the latching member 32 as described below. As may be seen in FIG. 3A, both the upper and lower latch teeth 54, 56 have flat bottom surfaces for engaging the flat top surfaces of the support projections 42, thereby providing the maximum surface area to distribute the load forces created by the user leaning on the second support member 16.

In the preferred embodiment, the resilient means is a generally U-shaped spring means 49 having first end 50 and a distal end portion 51. The first end 50 is integral with the first end 48 of the spring latch member 32. The distal portion 51 slidably engages one of the walls 40 of the tooth track plate 30. To this purpose, the distal portion 51 presents a smooth flat sliding abutment surface which spans multiple projections 42 at the opposite side of the opening 38. It will be appreciated, however, that the resilient means can be any shape which engages the spring latch member 32 and resiliently urges the teeth 54, 56 to engage the support projections 42. When the teeth 54, 56 are in the retracted sliding position shown in FIG. 3B, the second end 51 of the spring means 49 exerts a continuous force on the first end 48 of the spring means 49 and latch projections 54, 56, urging the latter to reengage the support projections 42 disposed on the wall 40 of the opening 38. Opening 38 can accommodate the spring latch member 32 when the latch projections 54, 56 engage the top-most support projection 42, e.g., having a single molded plastic part. In the embodiment illustrated in FIGS. 3A and 3B, the upper portion of opening 36 is semicircular shaped to accommodate the semicircular-shaped spring means 49 when the spring latch member 30 is positioned in the uppermost vertical position in the tooth track plate 30.

Manipulatable handle means 34 is provided for supporting the load on the second support member 16 and for selectively disengaging the teeth 54, 56 from the support projections 42 to permit sliding the spring latch member 32 along opening 38 in order to selectively adjust the vertical position of the arm rest 12. The handle means 34 is rigidly attached to the first end 48 of the spring latch member 32, which permits the user to manipulate the handle 34 to disengage the latch teeth 54, 56 from the support projections 42. The handle means 34 and the spring latch member 32 also cooperate to transfer the load of the second support member 16 to the support projections 42 of the tooth track plate 30 and thus to the lower support 14. It will also be appreciated that when the spring latch member 32 slides within the tooth track 30, the handle 34 and the second support member 16 will slide in unison, effecting the height of the second support member 16 to be readily adjusted.

Figure 3A:
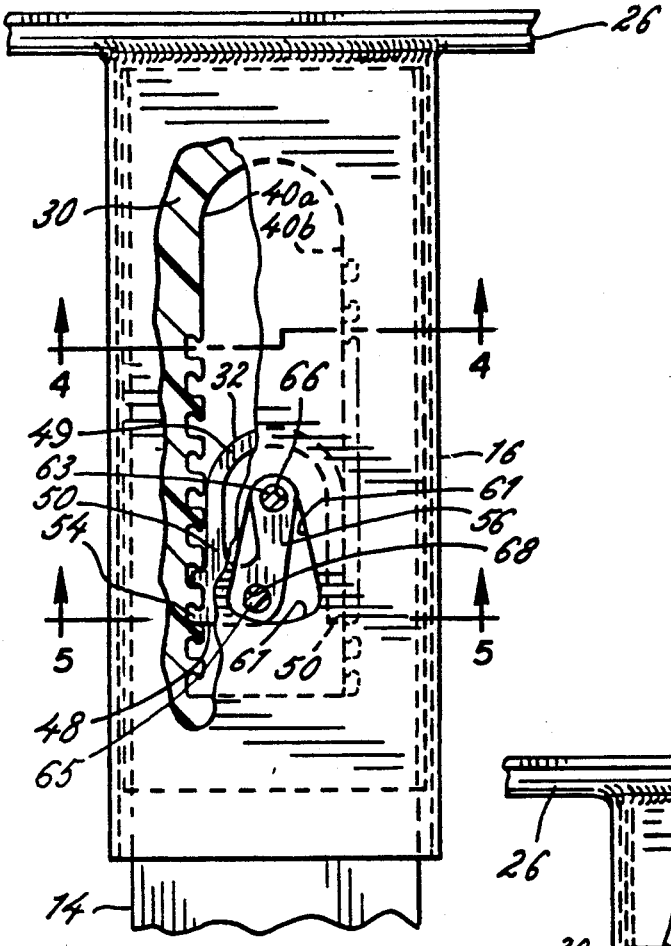
FIG. 3A is a front elevational view of the latch mechanism shown in FIG. 2 including a cut away portion showing the first or fixed position of the latch in which the latch projections engage the support projections of the tooth track plates.
Figure 3B:
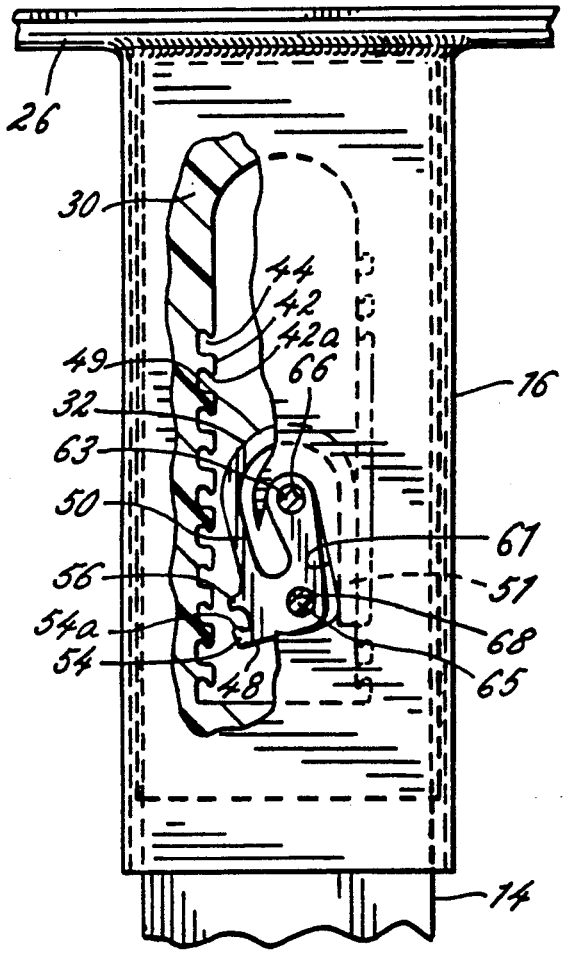
FIG. 3B is a similar front elevational view of the latch mechanism in FIG. 2 showing the second or retracted sliding position of the latch in which the latch projections are disengaged from the support projections of the tooth track plates.
Figure 6:
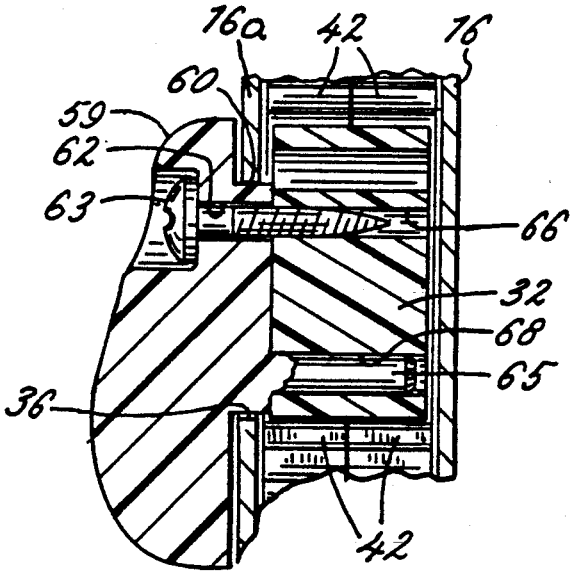
FIG. 6 is an enlarged cross-sectional view taken along line 6—6 in FIG. 1 showing the button handle attached to the spring latch member and supporting the second support member.
Figure 7:
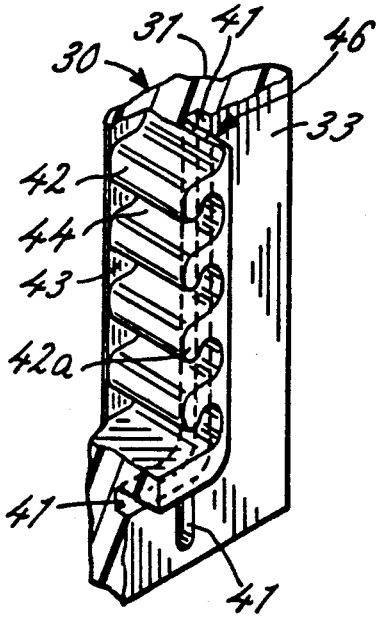
FIG. 7 is an enlarged perspective view of a portion of a tooth track plate shown in FIG. 2.

In order to support the second support member 16, the handle means 34 illustrated in FIGS. 1–2 and 6 includes a button handle 59 having an inwardly projecting shoulder 60. The shoulder 60 is adapted to engage rather closely with the upper and lower edges of an access opening 61 which is disposed generally in the center of one wall of the upright tubular portion 24 of the second support member 16. As shown in FIG. 6, the wall portion **16*a* at the upper edge of the opening 61 engages the shoulder 60. Thus, the entire weight of the second support member 16 and the weight of a user leaning on the arm rest portion 26 of the second support member 16 is transferred to the member 34 and therethrough to the latch member 32 and to the plate 30 and lower support 14. The opening 61 is of generally triangular configuration as seen in FIGS. 2, 3A and 3B, with an arcuate apex approximately centered on the axis of pivot hole 62 and with a broader base portion to permit the described pivotal movement of the lower portion of shoulder 60**.

In order to rigidly attach the handle to the spring latch member 32, the handle means 34 includes attachment means such as screws, pins and the like. In the embodiment illustrated in FIG. 6, the button handle 59 has an upper hole 62 which carries a retention screw 63 and a protruding pin 65. The latch portion of the spring latch member 32 has holes 66, 68 which are adapted to align with the upper hole 62 and pin 65 of the handle 59, respectively, and to receive the screw 63 and pin 65 as illustrated in FIG. 6. When the handle 59 is attached to the first end 48 of the spring latch member 32, the user may easily rotate the handle 59 (in a counterclockwise direction in FIGS. 3A and 3B) to disengage the latch projections 54, 56 from the support projections 42, in the sliding position. Since the handle 59 and the spring latch member 32 are rigidly attached and the handle 59 engages the upper support 16, all of these components move together as the user vertically positions the arm rest 12.

Figure 8:
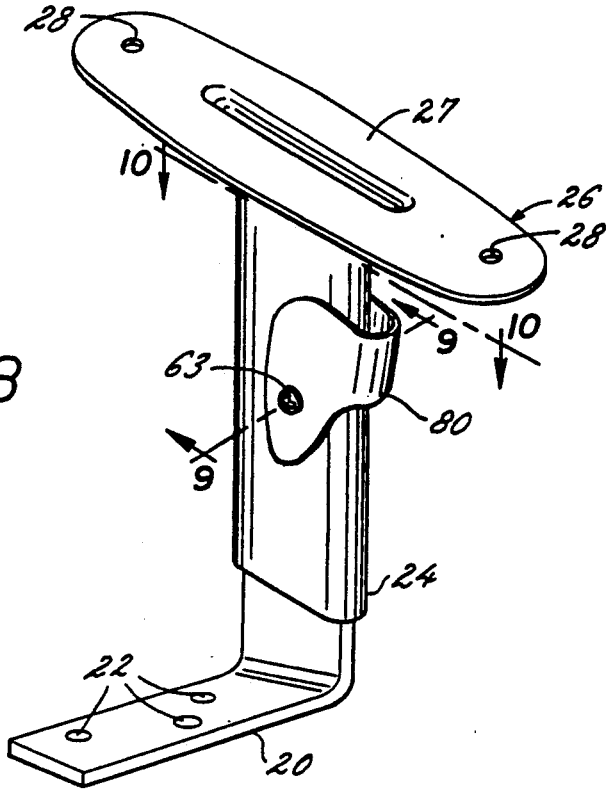
FIG. 8 is a perspective view of an alternate embodiment of the manipulatable handle means.
Figure 9:
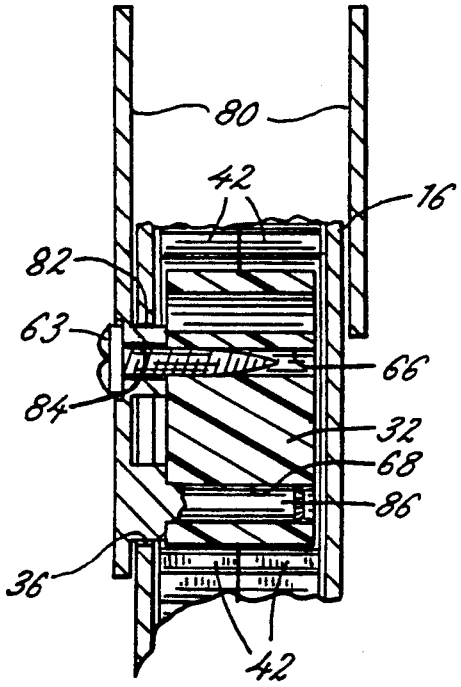
FIG. 9 is an enlarged cross-sectional view taken along line 9—9 in FIG. 8 showing the pistol grip handle attached to the spring latch member.
Figure 10:
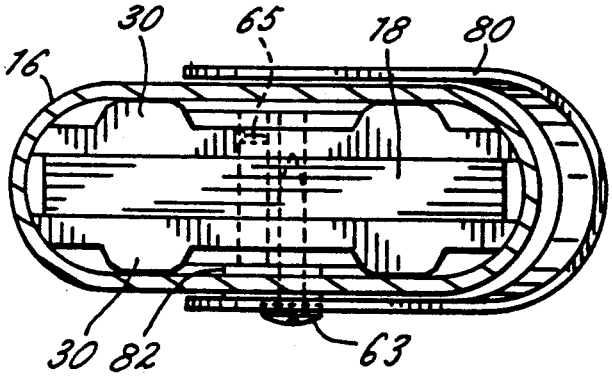
FIG. 10 is an enlarge cross-sectional view taken along line 10—10 in FIG. 8 showing the pistol grip handle attached to the spring latch member.

In the embodiment illustrated in FIGS. 8–10, the handle means 34 includes a pistol grip or trigger-like operating handle 80. The generally U-shaped trigger 80 fits loosely around one outer edge portion of the second support member 16. Like the button handle 59, the handle 80 has a shoulder 82 protruding from its inside wall to engage the upper edge of the access opening 61 in order to transfer the weight of the second support member 16 and the weight of the user leaning on the arm rest portion 26 to the latch member 32 and therethrough to the plate 30 and lower support 14.

The handle 80 is attached to the latch member 32 in a manner similar to the button handle 59. The handle 80 has an upper hole 84 and a protruding pin 86 which are adapted to align with the upper and lower holes 66, 68, respectively, of the latch member 32. In order to attach the handle 80 and the latch member, pin 86 is inserted into the lower hole 68 of the latch member 32. Thereafter, a retention screw 63 fastens latch member 32 through upper hole 66. When the handle 80 is attached to the latch member 32, the bight of the handle 80 is spaced outward from the subjacent edge of member 16 while retracted in the normal latching position. Thus, as the user squeezes the handle 80 toward the support 16 in the manner of a trigger, it causes the latch member 32 to rotate counterclockwise (as viewed in FIG. 8), thereby retracting the latch projections 54, 56 from the support projections 42 and permitting the second support member 16 to slide vertically.

While an integral pin 65, 86 is illustrated herein, it will be appreciated that this may be a separate pin member which is engaged in an opening in the handle as well as in the opening 68. Similarly, other spring arrangements may be provided for biasing the latch member to its engaged position. However, the illustrated unitary construction is preferred.

Upon reference to FIG. 3A, it will be seen that the upper and lower holes 66, 68 of the spring latch member 32 are positioned so that a plane passing through the centers of these lower holes converges downwardly with the line of projections 42 engaged by the latch teeth 54, 56. Therefore, the weight of the second support member 16 (and the user) tends to cause the spring latch member 32 to rotate into engagement with the projections 42 (clockwise in FIG. 3A), thereby urging the latch projections 54, 56 into engagement with the support projections 42 as the load increases. Furthermore, complementary angled inner engagement surfaces of downwardly projecting toes **42*a* and the projecting toe 54*a* of the tooth 54 assure that the latch will not accidentally disengage under opposite forces, e.g., if someone lifts upward on the arm rest 12**.

In accordance with one of the objects, the adjustable chair arm 11 can be easily and quickly assembled. In order to assemble the preferred embodiment of the adjustable chair arm 11, one of the tooth track plates 30 is positioned in the opening 36 of the first support member 14. The spring latch member 32 is then inserted from the rear of the tooth track plate 30 into opening 38. The front wall 43 of the recess 44 will prevent the spring latch member 32 from sliding through the opening 38. The second end portion 51 of the spring means 49 forcefully engages one of the side walls 40 of opening 38 and the latch projections 54, 56 will be aligned with and engage the recesses 44 formed by support projections 42, preventing spring latch member 32 from sliding within the opening 38 during the assembly of the chair arm 11. The upwardly extending toe **54*a* of the latch projection 54 will engage the downwardly extending toe 42*a* of the support projections 42. The second tooth track plate 30 is subsequently aligned and inserted into the opening 38 so that the individual support projections 42 are substantially aligned and the latch member 32** also engages correspondingly therewith.

After the two tooth track plates 30 are so assembled with the first support member 14 (with the spring latch member 32 in place), the upright tubular portion 24 of the second support member 16 slidably receives the upright portion 18 of first support member 14 and related assembled plates and latch.

In order to attach the handle 59 to the spring latch member 32, the first support member 14 is slidably positioned within the upright tubular portion 24 of the second support member 16 so that the spring latch member 32 is substantially aligned with and thus exposed through the opening 61. The pin 65 can then be inserted into the lower hole 68 of the spring latch member 32. The shoulder 60 or 82 of handle 80 is aligned with the opening 61 so that the upper hole 62, carrying screw 63, is aligned with the upper hole 66 and the pin 65 is aligned with the lower hole 68 of the spring latch member 32, respectively. The screw 63 is attached to hole 66 of the spring latch member 32, thereby rigidly attaching the handle 34 to the spring latch member 32.

When the spring latch member 32 and the handle 34 are attached, they will move in unison with the upper support 16 as the spring latch member 32 slides along the opening 38 of the tooth track plate 30.

Normally, only the portion 42 at one side of the plates are utilized in each installation. Accordingly, only one set is required. However, providing projections at both sides permits use of the same construction in both right and left side units. Also, the opening 61 and operating handle may be on the inside or outside of supports.

It will be appreciated that the load on the arm rest portion 26, such as by the user leaning thereon, is carried by the shoulder 60 or 82 of the respective handle 34 and is transmitted by the spring latch member 32 to the support projections 42 and thence to the lower support. The height of the chair arm 11 can be easily adjusted. In order to adjust the height of the chair arm 11, a user rotates the handle 34 (in a counterclockwise direction in the illustrated embodiment) causing the latch projections 54, 56 of the spring latch member 32 to disengage from the recesses 44 formed by the support projections 42. After the user selects the desired position of the second support member 16, the handle 34 is released so that the resilient spring means urges the latch projections 54, 56 to engage the support projections 42, thereby preventing the chair arm 16 from further movement. Further, the operating mechanism is entirely enclosed.

I claim as my invention:

1. An adjustable chair arm assembly comprising:

cooperating first and second support members which include means on one of said members for attachment of said one member to a seating support and means on the other of said members for attachment of an arm rest to said other member, said members including elongated upright portions in adjacent overlapping sliding relationship with one another, said overlapping portion of said first support member including a series of support projections fixedly disposed therealong, and a latch mechanism engaged with said second support member in a fixed position therealong, said latch mechanism including a latch member and a hand pivotable actuator, said latch member including at least one latch projection and being laterally movable and resiliently urged into engagement with said support projections, said pivotable actuator having a handle portion on one side of said second support member, said actuator extending through and having fixed pivotal engagement with said second support member and engaging said latch member in spaced relation to said fixed pivotal engagement of said actuator with said second support member for selectively retracting said latch member to disengage all of said latch projections from said support projections upon pivoting of said actuator and thereby permitting selective relative sliding movement between said support members for adjusting the height of said arm rest and then fixing said support members in selected positions to retain the arm rest in a selected height position by releasing said actuator whereby said latch projection engages said support projections and thereby retains said arm rest in the selected height position.

2. The invention set forth in claim 1 wherein said latch member is mounted for relative slidable movement along said support projections.

3. The invention set forth in claim 2 wherein said overlapping portion of said first support member has parallel opposing side sections defining a vertical slide space therebetween, said latch member being disposed in said slide space and movable therealong, said support projections disposed along at least one of said side sections for accepting said latch projection for selective engagement the thereby in such selected height positions.

4. The invention set forth in claim 3 comprising resilient means attached to said latch member and engaging said other of said side sections for urging said latch projection to engage said support projections.

5. The invention as set forth in claim 4 wherein said resilient means comprises a torsion spring.

6. The invention set forth in claim 1 wherein said first support member has parallel and opposing side sections defining a space therebetween for receiving at least one tooth track plate, and a tooth track plate having a portion for aligning with and snugly engaging said first support member in said space, said portion of said track plate defining an opening and having the support projections disposed therealong for accepting the latch projection.

7. The invention as set forth in claim 6 wherein said tooth track plate has a projecting shoulder on one side thereof for so engaging said first support member.

8. The invention set forth in claim 7 wherein said tooth track plate has a groove around said shoulder to receive and accommodate machining flaws and thereby ensuring that the surface of said tooth plate snugly engages the surface of said first support member.

9. The invention set forth in claim 1 wherein said upright portion of said second support member includes a tubular portion for slidably receiving and telescopically enclosing said upright portion of said first support member and said latch member and having an access opening disposed in said tubular portion permitting said hand pivotable actuator to be attached to said latch member through said access opening.

10. The invention as set forth in claim 9 wherein said hand pivotable actuator extends through said access opening and engages said tubular portion along an edge of said access opening for transfer of a load force between said second support member and said first support member.

11. The invention set forth in claim 1 wherein said actuator is joined to said latch member adjacent to said fixed pivotal engagement of said actuator with said second support member and adjacent to said latch projections such that all of said latch projections are disengaged from said support projections upon pivoting of said actuator.

12. An adjustable chair arm comprising cooperating first and second support members which include means on the first member for attachment of said first member to a seating support and means on said second member for attachment of an arm rest to said second member, said members including elongated upright portions in adjacent overlapping sliding relationship with one another, said overlapping portion of one of said members including spaced parallel and mutually opposing side sections providing a vertical slide space therebetween and having a series of support projections disposed along at least one of said side sections and extending inwardly relative to said slide space, a latch mechanism disposed between said side sections and laterally movable along said vertical slide space, said latch mechanism being resilient and compressively engaged between said side sections and including at least one latch projection for selectively engaging said support projections at various positions along said one of said side sections, and a pivotable latch operating member having a handle portion on one side of the other of said overlapping portions, said latch operating member extending through and having fixed pivotal engagement with the said other overlapping portion and joining said latch mechanism in spaced relation to said fixed pivotal engagement of said latch operating member with said other overlapping portion for fixing the position of said latch mechanism longitudinally of said other overlapping portion and manipulating said latch mechanism for selectively disengaging all of said latch projections thereof from said support projections upon pivoting of said latch operating member whereby said members may be slidably moved longitudinally relative to one another.

13. The invention as set forth in claim 12 wherein said latch mechanism comprises a latch member which includes said latch projection and resilient means engaging said latch projection and said other of said side sections and resiliently urging said latch projection to engage said support projections.

14. The invention set forth in claim 13 wherein the resilient means comprises a torsion spring.

15. The invention set forth in claim 13 wherein said latch member is integral with said resilient means.

16. The invention set forth in claim 12 wherein said upright portion of said other of said overlapping portions has a tubular portion for slidably receiving and telescopically enclosing said upright portion of said one member and said latch member and having an access opening disposed in said tubular portion permitting said hand pivotable actuator to be attached to said latch mechanism through said access opening so that movement of said hand pivotable actuator selectively disengages all of said latch projections from said support projections and said hand pivotable actuator engages said other support member and transfers the load on said arm rest through said latch projection to said support projections.

17. The invention as set forth in claim 12 and including a tooth track plate which has a shoulder of a configuration for aligning with and snugly engaging said one of said members between said side sections thereof, said plate defining said slide space and including said support projections.

18. The invention as set forth in claim 17 and wherein said latch mechanism includes a latch member which includes all of said latch projections projecting on one side thereof and a spring engaging said latch member and said plate for resiliently urging said latch projection into engagement with said support projections.

19. The invention as set forth in claim 18 wherein said spring is integral with said latch member.

20. The invention set forth in claim 18 wherein said upright portion of said other of said overlapping portions has a tubular portion for slidably receiving and telescopically enclosing said upright portion of said one member and said plate, latch member and spring, said tubular portion having an access opening permitting said hand pivotable actuator to be attached to said latch member through said access opening so that movement of said hand pivotable actuator selectively disengages said latch projection from said support projections and said hand pivotable actuator engages said other support member and transfers the load on said arm rest through said latch projection to said support projections.

21. The invention as set forth in claim 20 and wherein said spring is generally U-shaped and said latch member and spring are a unitary component.

22. The invention as set forth in claim 12 and wherein said latch mechanism includes a latch member which is mounted for pivotal movement about a first axis relative to said support member and which includes said latch projection on one side thereof and spaced from said pivot axis, and a spring engaging said latch member and one of said side sections for resiliently urging said latch projection into engagement with said support projections.

23. An adjustable chair arm assembly comprising:

cooperating first and second support members having elongated upright portions in adjacent overlapping sliding relationship with one another, said second support member having means for affixing an arm rest thereto and said first support member having means for attaching to a seat support and a series of support projections vertically disposed along said overlapping portion thereof, a latch member mounted for sliding movement relative to said support projections in a fixed position relative to said second support member, said latch member having at least one latch projection for engaging said support projections, resilient means engaging said latch member for resiliently urging said latch projection into engagement with said support projections thereby preventing said support members from sliding with respect to one another, and a hand pivotable actuator having a handle portion on one side of said second support member, said actuator extending through and having fixed pivotal engagement with said second support member, said actuator engaging said latch projection in spaced relation to said fixed pivotal engagement with said second member for selectively retracting all of said latch projections from said support projections upon pivoting of said actuator and thereby permitting selective sliding movement between said first and second support members for adjusting the height of said arm rest and then for selectively restraining said first and second support members from sliding movement and retaining said arm rest in a selected height position by releasing said hand pivotable actuator so that said resilient means urges said latch projections to resiliently engage said support projections.

24. The invention as set forth in claim 23 wherein the first support member comprises parallel and opposing side sections defining a vertical slide space therebetween for accepting said latch member which projects into and moves along said vertical slide space, at least the one of said sections having the support projections disposed therealong for accepting the latch projection of the latch member.

25. The invention set forth in claim 23 wherein the resilient means comprises a torsion spring.

26. An adjustable chair arm assembly comprising:

cooperating first and second support members which include means on one of said members for attachment of said one member to a seating support and means on the other of said members for attachment of an arm rest to said other member, said members including elongated upright portions in adjacent overlapping sliding relationship with one another, said overlapping portion of said first support member including a series of support projections fixedly disposed therealong, and a latch mechanism engaged with said second support member in a fixed position therealong, said latch mechanism including at least one latch projection which is resiliently urged into engagement with said support projections and hand manipulatable means for selectively retracting said latch projection from said support projections for permitting selective relative sliding movement between said support members for adjusting the height of said arm rest and then fixing said support members in selected positions to retain the arm rest in a selected height position by releasing said hand manipulatable means whereby said latch projection engages said support projections and thereby retains said arm rest in the selected height position, and wherein said first support member has parallel and opposing side sections defining a space therebetween for receiving at least one tooth track plate, and a tooth track plate having a shoulder portion on one side thereof for aligning with and snugly engaging said first support member in said space and a groove around said shoulder portion to receive and accommodate machining flaws and thereby ensuring that the surface of said tooth plate snugly engages the surface of said first support member, and said portion of said track plate defining an opening and having the support projections disposed therealong for accepting the latch projection.

27. An adjustable chair arm assembly comprising:

cooperating first and second support members which include means on one of said members for attachment of said one member to a seating support and means on the other of said members for attachment of an arm rest to said other member, said members including elongated upright portions in adjacent overlapping sliding relationship with one another, said overlapping portion of said first support member including a series of support projections fixedly disposed therealong, and a latch mechanism engaged with said second support member in a fixed position therealong, said latch mechanism including at least one latch projection which is resiliently urged into engagement with said support projections and hand manipulatable means for selectively retracting said latch projection from said support projections for permitting selective relative sliding movement between said support members for adjusting the height of said arm rest and then fixing said support members in selected positions to retain the arm rest in a selected height position by releasing said hand manipulatable means whereby said latch projection engages said support projections and thereby retains said arm rest in the selected height position, and wherein said first support member has parallel and opposing side sections defining a space therebetween for receiving at least one plastic molded tooth track plate, and a tooth track plate having a portion on one side thereof for aligning with and snugly engaging said first support member in said space, said portion of said track plate defining an opening and having the support projections disposed therealong for accepting the latch projection.

* * * * *